United States Patent [19]

Aspden

[11] 4,264,799

[45] Apr. 28, 1981

[54] ELECTRICAL SWITCHES

[75] Inventor: David Aspden, Lancashire, England

[73] Assignee: Lucas Industries Limited, Birmingham, England

[21] Appl. No.: 11,885

[22] Filed: Feb. 13, 1979

[30] Foreign Application Priority Data

Feb. 16, 1978 [GB] United Kingdom ..... 6120/78

[51] Int. Cl.[3] ..... H01H 3/20; H01H 9/20

[52] U.S. Cl. ..... 200/327; 200/314; 200/316; 200/328; 200/313

[58] Field of Search ..... 200/327, 328, 155 R, 200/156, 318, 321, 322, 159 R, 153 B, 336, 340, 42 R, 44, 42 T, DIG. 25, 314, 316

[56] References Cited

U.S. PATENT DOCUMENTS

| | | | |
|---|---|---|---|
| 3,288,973 | 11/1966 | Piber | 200/328 |
| 3,511,954 | 5/1970 | DiPilla | 200/328 |
| 3,867,596 | 2/1975 | Schadow | 200/328 |
| 3,973,097 | 8/1976 | Rosenberg et al. | 200/327 |
| 4,112,277 | 9/1978 | Kleeb | 200/322 |
| 4,160,143 | 7/1979 | Schlesier et al. | 200/328 |

*Primary Examiner*—Willis Little

*Attorney, Agent, or Firm*—Holman & Stern

[57] ABSTRACT

An electrical switch the body of which includes a base, and supports an operating member for rotational and axial movement relative to the body. The base is formed with an aperture and a light source support member is received in the aperture. Between the light source support member and the base there is defined a passage therein, in use, a region of an appropriately shaped blocking element can be received. The blocking element, when incorporated in the switch, extends into the path of either axial, or rotational movement of the operating member relative to the body to prevent such movement of the operating member.

15 Claims, 4 Drawing Figures

ELECTRICAL SWITCHES

This invention relates to electrical switches.

A known electrical switch has a body including a base member apertured to receive a light source whereby the operating member of the switch or part thereof or part of the switch body, can be illuminated from within the body. The known switch includes the facility of both axial and rotary movement of the operating member to operate the contacts of the switch. It is desirable to be able to produce such known switches and similar switches without the axial or the rotary movement facility using the maximum number of common components and common assembly sequences and it is an object of the present invention to facilitate such production.

An electrical switch according to the invention comprises a body including a base, an operating member supported by the body for rotational and axial movement relative thereto, an aperture extending through the base, and a light source support member received in said aperture, there being a passage defined between the light source support member and the base when the member is received in the aperture wherein, in use, if desired a region of an appropriately shaped blocking element can be received, said blocking element, if incorporated extending into the path of either axial or rotational movement, of the operating member relative to the body to prevent such movement of the operating member.

Preferably said support member and said base define between them a pair of passages on opposite sides respectively of the support member, said passages each, if desired, receiving a blocking element.

Desirably said passage or passages extend through the base so that a location member on the or each element can co-operate with the exterior of the base of support member.

Conveniently the switch body includes an internal surface engageable by an abutment of the or each blocking element whereby said surface accepts the loading of the or each element in the event that the operating member is subject to force to move the operating member in the blocked mode.

The invention further resides in an electrical switch comprising a body including a base, an operating member supported by the body for rotational and axial movement relative thereto, an aperture extending through the base, a light source support member received in said aperture, and a blocking element, said element extending within the body into the path of either axial or rotational movement of the operating member to prevent such movement of the operating member relative to the body, said element including a region located within a passage defined between the light source support member and the base.

Desirably, the passage extends through base and the element includes a location member engaging the exterior of the base or the support member.

Preferably the support member and the base define a pair of passages on opposite sides respectively of the support member and each passage receives a region of a respective blocking element.

Desirably the passages each extend through the base and each element includes a location member which engages the exterior of the base or support member.

Conveniently the two elements are integral with a common location member.

Preferably the body of the switch includes an internal surface which is engaged by an abutment of the or each element whereby said surface of the body accepts loading of the or each element when the operating member is subject to a force tending to move it in the blocked mode.

Preferably, the wall of the aperture in the base is formed with a groove or grooves which with the surface of the support member defines the or each passage.

Alternatively the wall of the support member is formed with a groove or grooves which with the wall of said aperture in the base defines the or each passage.

The invention still further resides in an electrical switch comprising a body including a base, an operating member supported by the body for axial and rotational movement relative thereto, and an aperture extending through the base for receiving a light source support member, the wall of said aperture having therein at least one groove which, with the surface of a light source support member received in the aperture, in use, defines a passage for receiving a region of a blocking element for resisting either axial or rotational movement of the operating member relative to the body.

The invention yet further resides in a light source support member for reception in an aperture in the base of the body of an electrical switch, the surface of the support member having therein at least one groove which, with the wall of said aperture in use, defines a passage for receiving a region of a blocking element for resisting either axial or rotational movement of an operating member of the switch relative to the body of the switch.

One example of the invention is illustrated in the accompanying drawings wherein.

Figure 1:
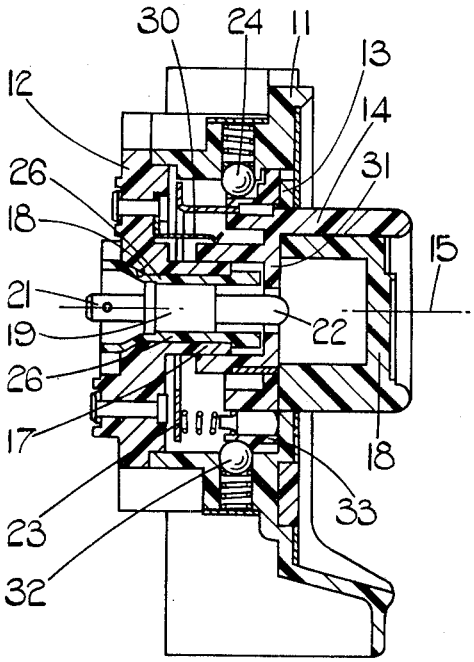
FIG. 1 is a sectional view of an electrical switch.

Referring to the drawings, the electrical switch includes a hollow moulded synthetic resin body 11 including a base 12 closing one end of the body 11. Extending through a cover region 13 integral with and partially closing the end of the body 11 remote from the base 12 is a moulded synthetic resin operating member 14. The operating member 14 is supported within the body 11 for both rotational movement about an axis 15 and for axial movement in the direction of the axis 15.

The base 12 is formed with a centrally disposed aperture 16 in the form of a through bore, the wall of the bore being extended within the body 11 to define a hollow sleeve 17 integral with, and upstanding from the inner surface of the base 12. The operating member 14 is hollow and includes a transparent or translucent region 18. Adjacent the outer surface of the base 12, the bore defining the aperture 16 is flared outwardly to define a frusto-conical recess 20. The bore defining the aperture 16 receives as a push fit therein a light source support member in the form of a cylindrical, moulded synthetic resin bulb holder 19. The bulb holder 19 is hollow, and carries bulb contacts defining terminals 21 at the exterior axial end of the bulb holder. Projecting from the interior axial end of the bulb holder 19 is an electric light bulb 22 which when energised, provides light illuminating the region 18 of the operating member 14.

The base 12 supports a plurality of fixed electrical contacts disposed within the body 11 and electrically connected by means of rivets to terminal members projecting from the exterior of the base 12. Disposed within the body 11, adjacent the fixed contacts is a moving contact plate 23 which is keyed to the operating member 14 so as to rotate therewith, and which is spring urged by springs acting between the contact plate 23 and the cover 13, towards the fixed electrical contacts disposed on the inner surface of the base 12, the springs extending through elongate slots in the member 14. Rotation of the operating member 14 results in rotation of the contact plate 23 and thus co-operation between the contact plate 23 and the fixed contact effects switching operations in the usual manner. A detent mechanism including a spring pressed ball 24 acts between the operating member 14 and the body 11 to define predetermined stable rotational positions of the operating member 14 relative to the body 11.

Figure 2:
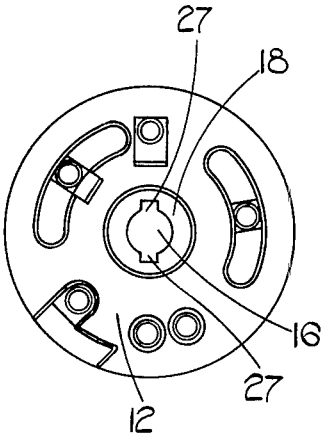
FIG. 2 is an end view of the base of the switch.
Figure 3:
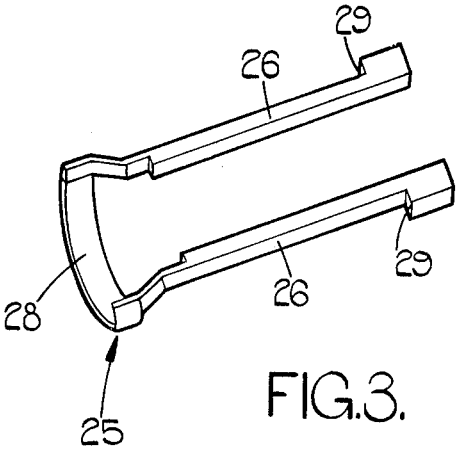
FIG. 3 is a perspective view, to an enlarged scale of a blocking member of the switch shown in FIG. 1.
Figure 4:
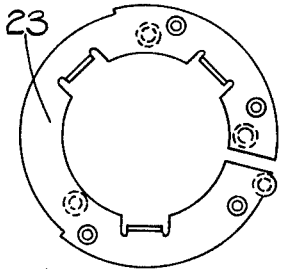
FIG. 4 is a plan view of the moving contact member of the switch.

As mentioned above the operating member 14 is capable of axial movement relative to the body 11 but in order to prevent such axial movement a blocking member 25 comprising a pair of blocking elements 26 is incorporated. The wall of the aperture 16 (as best seen in FIG. 2) is formed with a pair of diametrically opposed axially extending grooves 27. It will be recognised that when the cylindrical body of the bulb holder 19 is inserted into the aperture 16 the outer surface of the bulb holder and grooves 27 define a pair of diametrically opposed passages extending through the base 12. The grooves are extended along the inner surface of the sleeve 17. The blocking member 25 is in the form of a synthetic resin moulding comprising a pair of parallel limbs defining the blocking element 26. The elements 26 are interconnected at one end by means of an integral semi-circular strip 28, the plane of the semi-circular strip 28 lying at right angles to to length of the elements 26. Adjacent their junction with the strip 28 elements 26 are of reduced thickness so that the elements 26 can be flexed readily relative to the strip 28. Moreover, the diameter of the semi-circular strip 28 is greater than the spacing between the elements 26 and thus the reduced thickness regions are inclined outwardly. At their free ends each of the elements 26 includes an outwardly extending abutment shoulder 29.

The member 25 is inserted into the aperture 16 prior to insertion of the bulb holder 19. The elements 26 extend along the grooves 27 and the abutment shoulders 29 engage the innermost free end of the sleeve 17. The semi-circular strip 28 lies within the flared region 20 of the bore defining the aperture 16, and it will be recognised that insertion of the member 25 into the aperture 16 is facilitated by flexing the elements 26 towards one another. However, upon release of the elements 26 their inherent resilience causes them to engage in the grooves 27 with their abutments shoulders 29 engaging the end surface of the sleeve 17. Upon insertion of the bulb holder 19 the surface of the bulb holder 19 traps the elements 26 within the grooves 27. The free ends of the elements 26 lie closely adjacent a pierced transverse wall 31 of the operating member 14 and thus prevent axial movement of the operating member 14 in a direction to depress the operating member 14 into the body. The axial loading applied to the elements 26 is accepted by the sleeve 17 through the intermediary of the shoulders 29.

It will be recognised that the member 25 can be omitted without affecting the engagement of the bulb holder 19 in the aperture 16. A pair of passages defined in part by the grooves 27 are of course left, but nevertheless the bulb holder still fits, as a push fit, within the aperture 16. In the event that the member 25 is omitted then the operating member 14 can be moved axially as well as rotationally relative to the body 11. The base 12 can incorporate electrical contacts 30 operated by such axial movement of the operating member 14 and the switch incorporates a detent mechanism defining two stable axial positions of the operating member relative to the body, the axial movement of the operating member 14 to operate the contacts being depression of the member 14 into the body 11. A spring pressed ball 32 carried by the body 11 co-operates with a cam form 33 on the operating member 14 to define the detent mechanism, the cam form 33 including a rib over which the ball 32 rides during depression movement of the operating member 14.

It can be seen therefore that two basic switches can be manufactured using the same components. The first switches has the facility for both rotational and axial movement of the operating member 14, whereas the second switch by incorporation of the member 25 has only the facility for rotational movement of the operating member. If desired therefore two different switches, or two different ranges of switches can be produced from the same basic components, and indeed the two switches or ranges of switches can be identical other than the provision of the member 25. It will be understood that where the member 25 is to be incorporated then of course the detent arrangement defined by the spring pressed ball 32 and the cam form 33 and also the contacts 30 operated by axial movement of the operating member 14 are superfluous, but in the interest of a common assembly procedure, and in the interests of stocking only one set of switch components, it may prove more economical to incorporate the components 32, 33 and the axial movement contacts 30 even in switches which are intended to incorporate the member 25.

The member 25 will of course be incorporated into the switch as substantially the last assembly step. Thus switches which are complete other than for the insertion of the bulb holder 19, can be stored, and can then be either sold as switches having rotary and axial movement of the operating member merely by completing the stocked switches by insertion of the bulb holder 19, or alternatively if non-axial movement switches are required then again a switch is taken from the same stock but prior to insertion of the bulb holder 19 a member 25 is inserted. Alternatively the switches can be all assembled incorporating the member 25, the customer removing the member 25 in the event that a switch having both movements of the operating member is required.

It will be recognised that other forms of blocking element 26 can be utilised. While it is preferred to use a pair of blocking elements 26 on the common blocking member 25 it will be appreciated that if desired a single blocking element could be utilised in which case only a single groove 27 will be needed. Furthermore, while the example described above the grooves 27 are provided in the wall of the aperture 16 and the bulb holder body 19 is plain, it will be recognised that the bore defining the aperture 16 could be truly cylindrical, and grooves equivalent to the grooves 27 could be provided in the outer surface of the bulb holder body 19.

It will be understood that with minor modifications a switch can be produced utilizing the arrangements described above wherein the blocking elements block part or all of the rotary movement of the operating member while permitting axial movement.

I claim:

1. An electrical switch comprising a body including a base, an operating member supported by the body for movement in two modes along respective paths relative to said body, said two modes including a rotational mode and an axial mode, an aperture extending through the base, a light source support member received in said aperture, a passage defined between the light source support member and the base when the support member is received in the aperture, and blocking element means received in said passage for blocking movement of said operating member in one of said modes by extending into the respective path of movement of said operating member in said one mode.

2. A switch as claimed in claim 1, wherein the support member and said base define therebetween a pair of passages for receiving a respective portion of said blocking element means.

3. A switch as claimed in claim 2 wherein said passages extend through the base, and further comprising a location member on each blocking portion element cooperating with the exterior of the base and said support member.

4. A switch as claimed in any one of claims 1–3 wherein the switch body includes an internal surface engageable by an abutment of said blocking element means, whereby said surface accepts the loading of said blocking element means in the event that the operating member is subjected to force to move the operating member in said one mode.

5. An electrical switch comprising a body including a base, an operating member supported by the body for movement in two modes, namely a rotational mode and axial mode relative to said body, an aperture extending through the base, a light source support member received in said aperture, and a blocking element, said blocking element extending within the body into the path of movement of the operating member in one of said modes to prevent movement of the operating member in said one mode relative to the body, said element including a region located within a passage defined between the light source support member and the base.

6. A switch as claimed in claim 5 wherein the passage extends through the base and the element includes a location member engaging the exterior of the base and the support member.

7. A switch as claimed in claim 5 wherein the support member and the base define a pair of passages on opposite sides respectively of the support member and each passage receives a respective portion of said blocking element.

8. A switch as claimed in claim 7 in the passages each extend through the base and each blocking element portion includes a location member which engages the exterior of the base and support member.

9. A switch as claimed in claim 7 wherein the blocking element portions are integrally connected by a location member.

10. A switch as claimed in any one of claims 5 to 9 wherein the body of the switch includes an internal surface which is engaged by an abutment of the or each element portion whereby said surface of the body accepts loading of the or each element when the operating member is subject to a force tending to move it in the blocked mode.

11. A switch as claimed in any one of claims 5 to 9 wherein the wall of the aperture in the base is formed with a groove which with the surface of the support member defines said passage.

12. A switch as claimed in claim 10 wherein the wall of the aperture in the base is formed with a groove which with the surface of the support member defines said passage.

13. A switch as claimed in any one of claims 5 to 9 wherein the wall of the support member is formed with a groove which with the wall of said aperture in the base defines said passage.

14. A switch as claimed in claim 10 wherein the wall of the support member is formed with a groove which with the wall of said aperture in the base defines said passage.

15. An electrical switch comprising a body including a base, an operating member supported by the body for movement in two modes, namely an axial mode and a rotational mode relative to said body, an aperture extending through the base, a light source support member received in said aperture, and at least one groove in the wall of said aperture, said groove with the surface of said light source support member, in use, defines a passage for receiving a region of a blocking element for resisting movement of the operating member relative to the body in one of said modes.

* * * * *